United States Patent [19]

Kling

[11] Patent Number: 4,900,898

[45] Date of Patent: Feb. 13, 1990

[54] ELECTRIC SPACE HEATER

[76] Inventor: William E. Kling, deceased, 6647 Tanglewood, S.E., Grand Rapids, Mich. 49506, by Sue A. Kling, executrix

[21] Appl. No.: 146,241

[22] Filed: Jan. 20, 1988

[51] Int. Cl.[4] ..... F24H 3/02; F24H 7/04

[52] U.S. Cl. ..... 219/339; 219/341; 219/354; 219/359; 219/365; 219/366; 219/367; 219/368; 219/369; 219/370; 219/373; 219/377; 219/378; 219/382

[58] Field of Search ..... 219/354, 365, 377, 369, 219/339, 366, 368, 382, 374, 341, 367, 370, 359, 373, 378

[56] References Cited

U.S. PATENT DOCUMENTS

| | | | |
|---|---|---|---|
| 1,701,096 | 2/1929 | Bowling et al. . | |
| 1,731,472 | 10/1929 | Murray . | |
| 1,926,473 | 9/1933 | Wood | 219/365 |
| 1,928,270 | 9/1933 | Shirley . | |
| 2,230,440 | 9/1939 | Wiegand . | |
| 2,443,983 | 6/1948 | Gustafson | 219/365 |
| 2,512,892 | 6/1950 | Forsberg . | |
| 2,520,830 | 8/1950 | Borzner . | |
| 2,938,101 | 5/1960 | Borzner . | |
| 3,104,307 | 9/1963 | Garofalow et al. . | |
| 3,180,972 | 3/1965 | Covault . | |
| 3,396,458 | 8/1968 | Meng et al. . | |
| 3,473,006 | 10/1969 | Barbier . | |
| 4,307,284 | 12/1981 | Perron . | |
| 4,309,594 | 1/1982 | Jones . | |
| 4,416,068 | 11/1983 | Nilsson | 219/354 |
| 4,680,448 | 7/1987 | Fester . | |

FOREIGN PATENT DOCUMENTS

| | | | |
|---|---|---|---|
| 2442409 | 6/1980 | France . | |
| 57-150738 | 9/1982 | Japan | 219/354 |
| 332709 | 7/1930 | United Kingdom . | |

*Primary Examiner*—E. A. Goldberg
*Assistant Examiner*—Scott A. Rogers
*Attorney, Agent, or Firm*—Varnum, Riddering, Schmidt & Howlett

[57] ABSTRACT

An electric space heater includes an exterior case (10) which encloses an insulated heater core housing (12). Heat is generated in the heater core (14) by elongated incandescent ultraviolet lamps (64) mounted in a frame (60) inside the core housing (12). A porous aluminum sheet heat exchanger (68) surrounds the lamps (64) on three sides and extends the length of the lamps. A fan (34) mounted in an inlet opening (27) of a rear wall (22) of the case (10) forces air through an opening (52) in the core housing (12) through the heat exchanger (68) and around the lamps, and through outlet openings (28, 54) to the space to be heated. The core housing (12) is U-shaped with curved portions (46, 48) to laminate the air flow.

40 Claims, 4 Drawing Sheets

ELECTRIC SPACE HEATER

BACKGROUND OF THE INVENTION

1. Field of the Invention

This invention relates generally to electric space heaters, and more particularly, to space heaters wherein air is heated by moving the air through a heat exchanger which is heated by elongated incandescent lamps.

2. Description of the Prior Art

The concept of an electric space heater utilizing incandescent or other electric lamps as a heat source, with a fan and a heat exchanger mounted within a housing is well known. An example of such a space heater is disclosed in U.S. Pat. No. 4,307,284 issued to Leo Perron on Dec. 22, 1981. Perron discloses an electrical space heater unit in which conventional incandescent bulbs are mounted in a housing and a metal strip with metal fins is provided directly above and in contact with the incandescent bulbs to serve as a heat exchanger. The upper portion of the housing is open for passage of heated air from the housing into the space to be heated.

Another electric space heater is disclosed in U.S. Pat. No. 4,309,594 issued to John P. Jones on Jan. 5, 1982. Jones discloses a modular space heater device in which conventional infrared heat lamps are mounted in a housing and a heat exchanger plate is mounted above the bulbs. The heat exchanger plate has a number of openings with open ended pipes mounted in the openings for air to pass through. A fan blows air from an inlet in the housing across the infrared bulbs, around the heat exchanger plate, through the tubes in the heat exchanger plate and through an open outlet in the housing.

U.S. Pat. No. 4,680,448 issued to Earl Fester on July 14, 1987 discloses a space heater very similar to the heater disclosed by Jones, but with a different type of heat exchanger. Fester discloses a heat exchanger comprising a plurality of parallel copper tubes, surrounded by a plurality of parallel aluminum fins connected to and perpendicular to the tubes. A portion of the fins are coated with a black carbon paint.

The above-described space heaters fail to maximize efficiency because the heat exchangers do not surround the heat source, and thus do not absorb and transfer as much heat as possible. Considerable heat from the lamp is lost because it is directed away from the heat exchanger. Also, existing units seem to cause undue turbulence of the air flow, thus reducing efficiency. The sharp corners or convoluted air flow channels of existing heaters generate turbulence. The spherical or conical shape of the lamps which serve as a heat source also contribute to turbulence. Furthermore, the spherical or conical shape of the lamps in existing heaters creates an uneven distribution of heat in the heat exchangers. Existing portable space heaters can generally produce approximately 5200 BTU of heat at 1500 watts of power.

It is desirable to be able to enhance the efficiency of such electric space heaters by maximizing the heat transfer from the heat source to the air moving through the space heater. Efficiency can be enhanced by providing means to more evenly distribute heat over a heat exchanger, enabling the heat exchanger to absorb more heat, and laminating the air flow through the heater.

SUMMARY OF THE INVENTION

The invention relates to an electric space heater having a housing with an inlet opening on one side and an outlet opening on another side, a heat source within the housing, a heat exchanger adjacent the heat source for receiving heat therefrom and means to drive air from an inlet across the heat exchanger to absorb the heat therefrom and through the outlet opening. According to the invention the heat source comprises at least one elongated lamp and the heat exchanger comprises a sheet material at least partially surrounding the elongated lamp and in closely spaced relationship thereto.

The elongated lamps are high-intensity light bulbs, preferably those which have a length-to-diameter ratio in the range of 5:1 to 15:1, preferably about 10:1. The preferred elongated lamps are quartz UV lamps.

The heat exchanger is made of a sheet material having high thermal conductivity. Preferably, the thickness of the sheet material is in the range of 0.010 to 0.030 inches and has a pattern of openings therein. The openings in the heat exchanger sheet material comprise from 40 to 65 percent of the surface area of the sheet, preferably about 55 percent. Further, the openings have an average diameter in the range of 0.25 inches to 0.5 inches, preferably about 0.375 inches. Preferably, the sheet material is formed from an aluminum sheet having a thickness of about 0.020 inches thick and has openings in the sheet material which comprise about 55 percent of the surface area of the sheet.

The heat exchanger sheet is configured so that it extends at least 270° around the at least one elongated lamp. The heat exchanger preferably is folded in accordion fashion to provide multiple layers of the sheet. Further, the heat exchanger is preferably rectangular in cross-section and there are at least two elongated lamps positioned within the heat exchanger.

The inlet opening of the housing is preferably positioned in a central portion of the one side of the housing adjacent a side of the heat exchanger to direct air directly against the heat exchanger side. Further, the outlet opening is preferably positioned on an opposite side of the housing from the heat exchanger so that the air must flow through and around the heat exchanger between the inlet and the outlet openings in the housing. Preferably, there are two outlet openings in the housing, each positioned at an opposite end of the opposite side of the housing. The means to drive the air from the inlet across the heat exchanger preferably comprises a fan in the inlet opening. The housing is preferably insulated and has means for directing the air in a smooth laminar flow through the housing.

The interior surfaces of the heater and the heat exchanger are coated with a heat absorbing coating to enhance the heat transfer between these surfaces and the air.

BRIEF DESCRIPTION OF THE DRAWINGS

The invention will now be described with reference to the accompanying drawings in which.

DETAILED DESCRIPTION OF THE DRAWINGS

Figure 1:
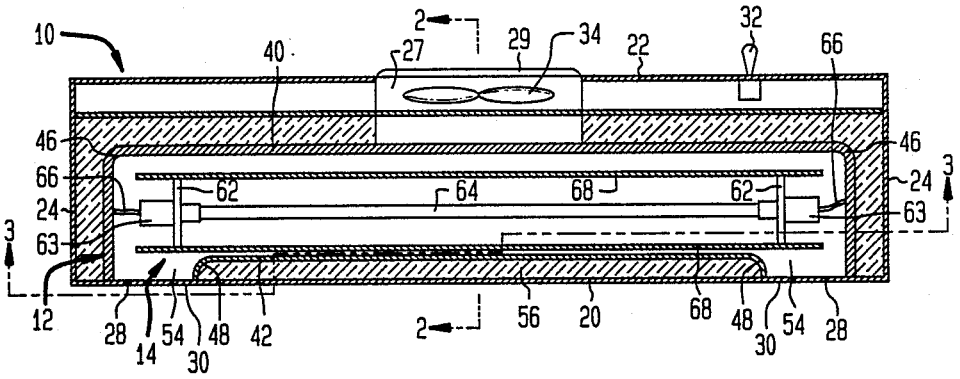
FIG. 1 is a plan view in section of an electric space heater according to the invention.
Figure 2:
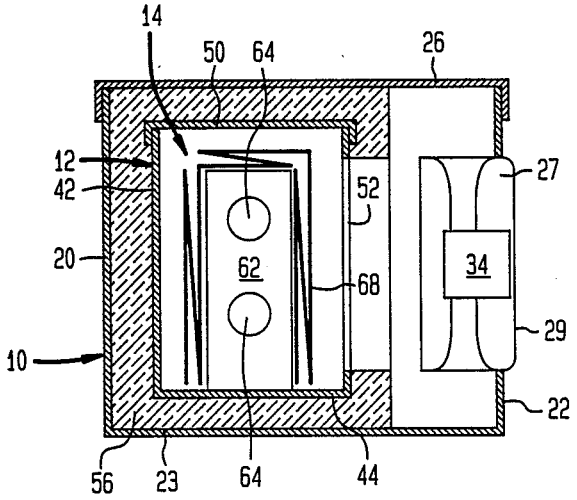
FIG. 2 is a cross-sectional view of the space heater of FIG. 1 taken along lines 2—2 thereof.
Figure 3:
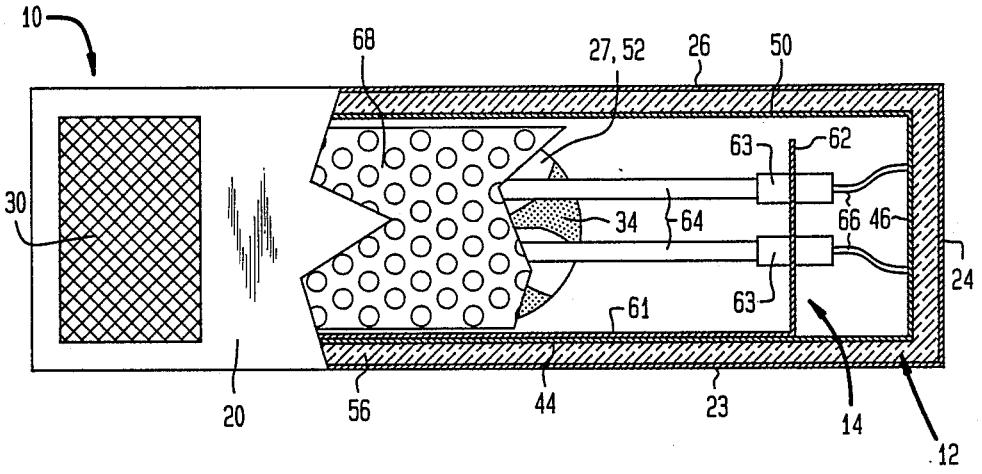
FIG. 3 is a front elevational view, in section, of the space heater of FIG. 1, taken along lines 3—3 thereof.

Referring now to FIGS. 1, 2, 3, and 4, there is shown a preferred embodiment of an electric space heater constructed in accordance with the invention. The heater comprises generally an exterior case 10, a core housing 12 mounted inside the exterior case 10, and a heater core 14 mounted inside the core housing 12.

The exterior case 10 is generally a box-like structure comprising a front wall 20, a rear wall 22, a bottom 23, two opposing side walls 24 and a top wall 26. The case 10 can be constructed of metal, or any other suitable material able to withstand heat, in order to provide an aesthetically pleasing appearance to the case 10. An inlet opening 27 is defined centrally in the rear wall 22. Two outlet openings 28 are provided in the front wall 20, one at each end thereof. An intake grill 29 covers the inlet opening 27 for protection, and likewise, each outlet opening 28 is protected by an outlet grill 30. An axial fan 34 is mounted in the inlet opening 27 to force air to the interior of the case 10. A switch 32 can be mounted on the case 10, preferably on the rear wall 22. The top wall 26 is removable to provide access to the interior of the case 10. Alternatively, the top 26 can be hinged to one of the walls 20, 22, 24.

The exterior case 10 encloses a core housing 12. The core housing 12 comprises a rear wall 40 and a front wall 42 rigidly secured to a bottom 44. The rear wall 40 has a rear curved portion 46 at each end thereof, and the front wall 42 likewise has a front curved portion 48 at each end thereof. The curved portions 46, 48 are aligned such that the core housing 12 forms a U-shaped channel. The curved portions 46, 48 are provided in order to establish a more laminar flow of air through the core housing 12. A top 50, roughly conforming to the same shape as the bottom 44, is removably mounted to the walls 40, 42 to permit access to the interior. A core inlet opening 52 is disposed in the rear wall 40 of the core housing 12, such that when the core housing 12 is mounted in the exterior case 10, the core inlet opening 52 is aligned with and adjacent to the fan 34 mounted in the exterior case 10. Each end of the core housing 12 has a core outlet opening 54. The core housing 12 is dimensioned such that each core outlet opening 54 is aligned with and has roughly the same geometric shape as the corresponding outlet openings 28 of the case 10 when the core housing 12 is mounted in the exterior case 10. Also, the core outlet openings 54 are immediately adjacent to the case outlet openings 28 so as to provide two contiguous outlets from the interior of the core housing 12 to the space to be heated. Insulation 56 completely surrounds the core housing 12 inside the exterior case 10 with the exception of the core inlet opening 52 and core outlet openings 54. The insulation 56 should preferably be of a type graded to a maximum temperature of 1200° F. A suitable insulation is 1 inch thick K-FAC 19 high temperature board manufactured by U.S. Gypsum Co. The core housing is preferably made of aluminum of a thickness up to 0.060 inches, more or less. Materials other than aluminum can also be used, if they sufficiently retain heat inside the core housing 12. The entire interior of the core housing 12 is coated with a high heat absorbant paint, for example Thurmalox TM, manufactured by Dampney Co., 85 Paris St., Everett, Mass. 02149. The paint should preferably be black in color in order to absorb and retain as much heat as possible.

The core housing 12 completely encloses a heater core 14. The heater core comprises a U-shaped frame 60, which can be made of the same material as the core housing 12. The frame 60 comprises a base 61 and two oppositely disposed arms 62 extending perpendicularly from the ends of the base 61. The frame 60 is thus adapted to hold a plurality of elongated incandescent lamps 64 which serve as a heat source. In a preferred embodiment, each lamp is a red quartz infrared lamp, of conventional design preferably having a length-to-diameter ratio in the range of 5:1 to 15:1. For example, lamp no. QHT3 manufactured by General Electric Corporation, which draws approximately 375 watts of power can be used. Each lamp 64 is preferably mounted by inserting each end thereof in a spring-loaded porcelain bulb holder 63, which in turn is secured to each opposing arm 62 of the frame 60. Thus, each lamp 64 extends between the opposing arms 62 of the frame 60. While the actual number of lamps may vary, the embodiment shown herein includes two lamps positioned in vertical juxtaposition in the frame 60. Wiring 66 extends to and from the lamps and should be suitably insulated to a temperature of 1200° F.

A heat exchanger 68 longitudinally surrounds the lamps 64 and extends slightly beyond the arms 62 of the frame 60 on three sides. The heat exchanger 68 is preferably made of a high heat conductivity sheet material, such as aluminum, and further comprises a multiplicity of small openings or open mesh pattern to form a foraminous sheet and to allow the free flow of air through the exchanger 68. The openings can be of any pattern: round, square or cross shaped. Aluminum screen could also be used for the heat exchanger. The sheet material forming the exchanger is preferably relatively thin, for example in the range of 0.010 to 0.030 inches thick. In the preferred embodiment described herein, the heat exchanger 68 is formed from 0.020 inch thick aluminum sheet with a pattern of cross openings. The average mean diameter of the openings is preferably about 0.375 inches and spaced apart such that the total area of the openings comprise about 55 percent of the surface area of the exchanger 68. The total area of the openings can range anywhere from approximately 40 percent to 65 percent of the total surface area of the sheet. Typically, each opening ranges from 0.25 to 0.50 inches mean diameter. The exchanger 68 can have a plurality of layers of the high heat conductivity material surrounding the lamps 64. The layers can be connected to each other in suitable fashion, or, as shown in the present embodiment, made of one piece of material folded back on itself in accordion-like fashion to form a plurality of layers on each of the three sides of the heat generating lamps 64. The function of the heat exchanger is to absorb heat from the lamps and transfer that heat to air which passes over the surfaces thereof. The heat exchanger must also permit the flow of air therethrough to cool the lamps and take heat from the space between the lamps 64 and the heat exchanger 68. The heat exchanger 68 can be dimensioned to slidably engage the arms 62 of the frame 60. It can thus be held in place by frictional engagement of the interior layer of the exchanger 68 with the sides of the arms 62. Alternatively, a suitable fastening means such as screws or pins can be provided to secure the heat exchanger 68 to the frame 60. The heat exchanger 68 is preferably coated with the same heat absorbent paint as the interior of the core housing 12, as is the frame 60.

Figure 5:
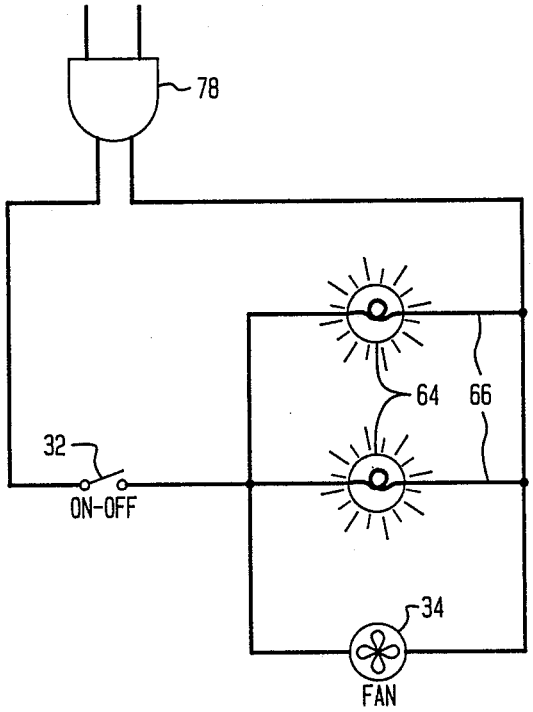
FIG. 5 is an electrical schematic diagram of a circuit suitable for use in the space heater shown in FIGS. 1 through 3.

FIG. 5 illustrates a preferred electrical circuitry to operate the space heater according to the invention. The fan 34 and lamps 64 are connected in parallel to a conventional 120 volt a.c. source by means of a standard plug 78. The on-off switch 32 controls the activation and deactivation of the fan 34 and lamps 64. Because the fan 34 and lamps 64 are connected in parallel, when one is activated they all are activated. The core 14 is preferably grounded by conventional means. A high temperature limiting switch (not shown) can be disposed at any suitable location in the core housing 12 and electrically connected between the power source and the switch 32. Thus, when the temperature in the core exceeds a predetermined level, the switch will automatically cut off electrical power to the fan 34 and lamps 64, preserving the life of the components and providing a margin for safety in the use of the heater. Also, a thermostat (not shown) can be incorporated into the electrical circuitry to automatically control the activation and deactivation of the fan 34 and lamps 64 in response to changes in the ambient temperature.

In operation, the fan 34 in the exterior case 10 draws air into the unit through the inlet opening 27 of the exterior case 10 and forces it into the core housing 12 through the core inlet opening 52. The lamps 64 in heater core 14 generate heat which is taken up and absorbed by the heat exchanger 68, and, to a somewhat lesser extent, the interior of the walls of the core housing 12. The air passing from the core inlet opening 52 of the core housing 12 passes through the openings in the heat exchanger 68 and is deflected through the core housing 12, all the while absorbing heat from the heat exchanger 68 and the interior of the core housing 12. The air is directed through the U-shaped passageway formed by the core housing 12 to exit from the core outlet openings 54 of the core housing 12, which are directly aligned with and adjacent to the outlet openings 28 of the exterior case 10, into the space to be heated. The curved portions 46, 48 of the core housing 12 serve to smooth and laminate the air flow, thus reducing turbulence and increasing the efficiency of the unit. The use of an elongated lamp 64 adjacent to and surrounded on at least three sides by the heat exchanger 68 serves to enhance the efficiency of the heat transfer from the heat source to the heat exchanger and permit a more even distribution of heat throughout the heat exchanger.

Tests of a prototype space heater constructed in accordance with the invention have shown that 11,000 BTU of heat can be generated from approximately 600 watts of power. The particular unit tested drew 5.5 amps of current. The heater core of the tested unit comprised two 8 inch long quartz infrared lamps, each approximately 0.75 inches in diameter spaced apart about 0.5 inches. A single layer of sheet aluminum, 0.020 inches thick, surrounded the lamps on three sides with less than 2 inches of space therebetween. Cross-shaped perforations in the sheet had a mean diameter of 0.375 inches and the total area of the openings comprised about 55 percent of the total surface area of approximately 70 square inches. The total area of the outlet openings measured approximately 15 square inches. Air at an ambient temperature of 70° F. was forced through the unit at 70 CFM. After seven minutes of operation, the air temperature at the outlets measured 300° F.

Figure 4:
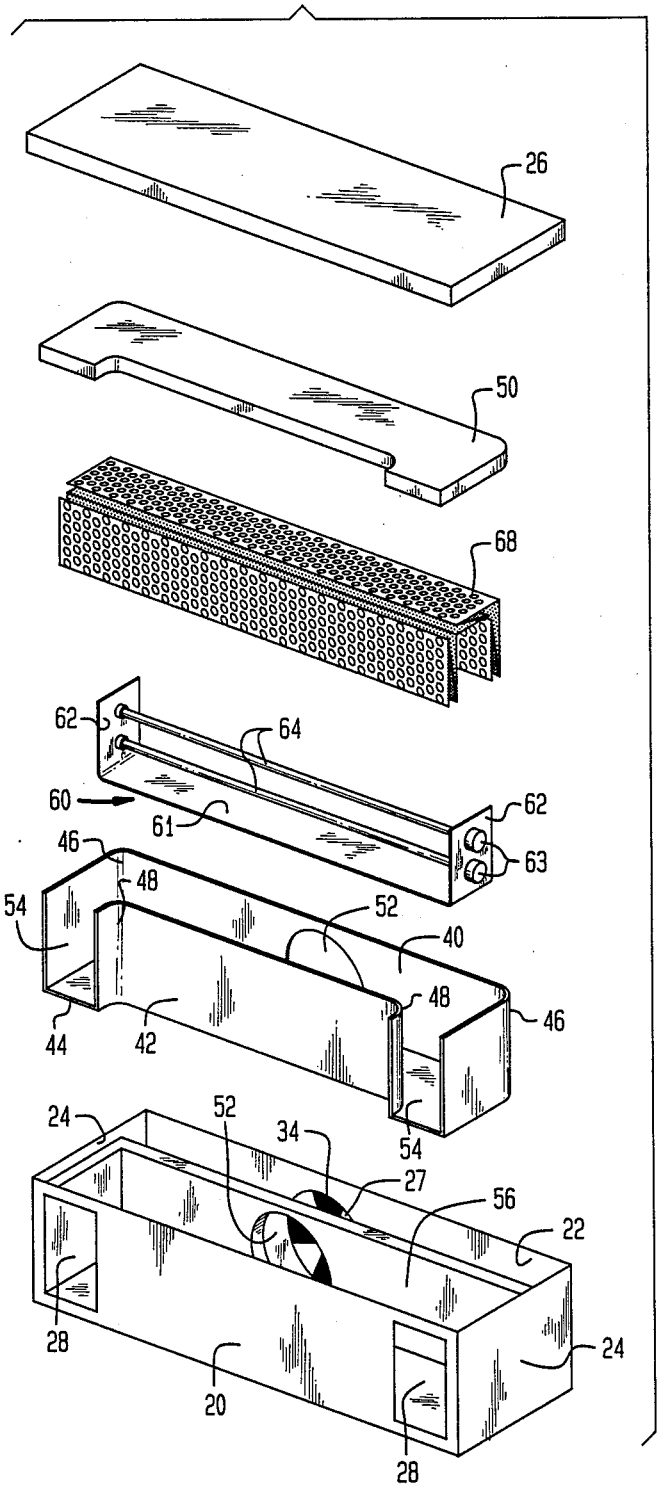
FIG. 4 is a perspective exploded view of the space heater of FIGS. 1 through 3.

As can be seen in FIG. 4, replacement of the internal components of the heater can be easily accomplished by removing the top wall 26 from the exterior case 10 to expose the core housing and a portion of the electrical circuitry. Likewise, the top 50 of the core housing 12 can be removed to expose the core 14. Further, the heat exchanger 68 can be pulled vertically off of the frame 60 to expose the lamps 64. In addition, the materials for construction are relatively inexpensive, thus reducing the costs of manufacture.

A space heater in accordance with the invention can be adapted for use in remote vehicles such as automobiles, trucks, recreation vehicles and the like by modifying the electrical circuitry and the heat generating lamps to operate from direct current. The small, relatively compact size of an electric space heater afforded by the present invention also makes it adaptable for use in clothes dryers and other appliances. It is also possible to completely enclose the lamps by the heat exchanger to 360° by adapting the means to hold the lamps. The close spacing between the high intensity lamps and the heat exchanger, the thin porous nature of the heat exchanger and the configuration of the heat exchanger and the lamps make the heater very efficient and very compact.

It will thus be seen that according to the present invention an electric space heater has been provided with enhanced efficiency, simplified design, and less cost. Reasonable variation and modifications are possible within the scope of the foregoing disclosure and drawings without departing from the spirit of the invention which is defined by the appended claims.

The embodiments of the invention in which an exclusive property or privilege is claimed are defined as follows:

1. In an electric space heater comprising:

a housing having an inlet opening at one side and an outlet opening at another side thereof;

a heat source within the housing;

a heat exchanger adjacent to the heat source for receiving heat from the heat source; and means to drive air from the inlet opening by way of the heat exchanger to absorb heat therefrom and out through the outlet opening of the housing, the improvement which comprises:

said housing being substantially closed;

said heat source comprising at least one elongated lamp, said elongated lamp having a longitudinal axis which is substantially transverse to the direction of the flow of air from said inlet opening; and the heat exchanger comprising a foraminous sheet material at least partially surrounding the at least one elongated lamp in closely spaced relationship thereto, said foraminous sheet having at least one face which is substantially transverse to the direction of the flow of air from said inlet opening and between the inlet opening and the elongated lamp, whereby the air from the inlet opening is driven against and through said foraminous sheet material and around said at least one elongated lamp to absorb heat from said elongated lamp and from said foraminous sheet material in turbulent flow.

2. An electric space heater according to claim 1 wherein the length of the elongated lamp is substantially equivalent to the width of the foraminous sheet.

3. An electric space heater according to claim 2 wherein said at least one elongated lamp is a quartz infrared lamp.

4. An electric space heater according to claim 2 wherein the heat exchanger sheet material has a high thermal conductivity.

5. An electric space heater according to claim 4 wherein the heat exchanger sheet material has a thickness in the range of 0.010 to 0.030 inches.

6. An electric space heater according to claim 5 wherein the openings in the heat exchanger sheet material have an average mean diameter in the range of 0.25 to 0.50 inches and comprise from 40 to 65 percent of the surface area of the sheet, whereby air can flow through said heat exchanger and around said elongated lamps.

7. An electric space heater according to claim 6 wherein the heat, exchanger sheet material is formed of an aluminum sheet with a thickness of about 0.020 in. the openings in the sheet comprise about 55 percent of the surface area of the sheet, and the average mean diameter of the openings is about 0.375 inches.

8. An electric space heater according to claim 7 wherein the heat exchanger sheet extends at least 270° around the elongated lamp.

9. An electric space heater according to claim 8 wherein the heat exchanger sheet is folded in an accordion fashion to provide multiple layers of the sheet.

10. An electric heater according to claim 9 wherein the heat exchanger is rectangular in cross-section and there are at least two of the elongated lamps positioned within the heat exchanger.

11. An electric space heater according to claim 10 wherein the inlet opening is positioned in a central portion of the one side of the housing adjacent a side of the heat exchanger to direct air directly against said heat exchanger side.

12. An electric space heater according to claim 11 wherein the outlet opening is positioned on an opposite side of the housing and on an opposite side of the heat exchanger.

13. An electric space heater according to claim 12 wherein there are two outlet openings in the housing, each positioned at an opposite end of the opposite side of the housing.

14. An electric space heater according to claim 13 wherein the housing has insulated outer walls.

15. An electric space heater according to claim 13 wherein the air driving means comprises a fan in the inlet opening.

16. An electric space heater according to claim 12 wherein the air-driving means comprises a fan in the inlet opening.

17. An electric space heater according to claim 11 wherein the air-driving means comprises a fan in the inlet opening.

18. An electric space heater according to claim 8 wherein the inlet opening is positioned in a central portion of the one side of the housing adjacent a side of said heat exchanger to direct air directly against the heat exchanger side.

19. An electric space heated according to claim 6 wherein the heat exchanger is rectangular in cross-section and there are at least two of the elongated lamps positioned within the heat exchanger.

20. An electric space heater according to claim 19 wherein the inlet opening is positioned in a central portion of the one side of the housing adjacent a side of the heat exchanger to direct air directly against and through the heat exchanger side.

21. An electric space heater according to claim 5 wherein the heat exchanger sheet extends at least 270° around the elongated lamps.

22. An electric space heater according to claim 21 wherein the heat exchanger is rectangular in cross-section and there are at least two of the elongated lamps positioned within the heat exchanger.

23. An electric space heater according to claim 22 wherein the inlet opening is positioned in a central portion of the one side of the housing adjacent a side of the heat exchanger to direct air directly against the heat exchanger side.

24. An electric space heater according to claim 23 wherein the air-driving means comprises a fan in the inlet opening.

25. An electric space heater according to claim 1 wherein the heat exchanger sheet material has a high thermal conductivity and a thickness in the range of 0.010 to 0.030 inches.

26. An electric space heater according to claim 25 wherein the openings in the heat exchanger sheet material comprise from 40 to 65 percent of the surface area of the sheet.

27. An electric space heater according to claim 26 wherein the heat exchanger sheet material is formed of aluminum sheet with a thickness of about 0.020 inches, the openings in the sheet material comprise about 55 percent of the surface area of the sheet and the average mean diameter of the openings is about 0.375 inches.

28. An electric space heater according to claim 27 wherein the heat exchanger sheet extends at least 270° around the at least one elongated lamp and the heat exchanger sheet is folded in accordion fashion to provide multiple layers of said sheet.

29. An electric space heater according to claim 28 wherein the heat exchanger is rectangular in cross-section and there are at least two of the elongated lamps positioned within the heat exchanger.

30. An electric heat exchanger according to claim 29 wherein the inlet opening is positioned in a central portion of the one side of the housing adjacent a side of the heat exchanger whereby air is directed against and through the heat exchanger side.

31. An electric heat exchanger according to claim 30 wherein the outlet opening is positioned on an opposite side of the housing and on an opposite side of the heat exchanger.

32. An electric heat exchanger according to claim 31 wherein the air-driving means comprises a fan mounted in said inlet opening.

33. An electric heat exchanger according to claim 1 wherein surfaces of said heat exchanger are coated with a heat absorbing coating to enhance the heat transfer between the air and the heat exchanger.

34. In an electric space heater comprising:

a substantially closed housing having an inlet at one side thereof and an outlet at another side thereof;

a heat source within the housing;

a heat exchanger adjacent to the heat source for receiving heat from the heat source; and means for driving air from the inlet by way of the heat exchanger to absorb heat therefrom and through the outlet of the housing, the improvement which comprises:

the heat source including at least one elongated lamp; and the heat exchanger including a foraminous sheet, at least one face of the sheet being disposed in a position adjacent to said heat source and between the heat source and the inlet, substantially transverse to the direction of flow of air at said position.

35. An electric space heater according to claim 34 wherein said face is substantially parallel to said elongated lamp.

36. An electric space heater according to claim 34 wherein said foraminous sheet is folded in accordionlike fashion to form multiple faces substantially transverse to the direction of flow of air.

37. An electric space heater according to claim 36 wherein at least one of the multiple faces is disposed between said air driving means and said heat source, and at least another of the multiple faces is disposed between said heat source and said outlet.

38. An electric space heater according to claim 34 wherein said foraminous sheet at least partially surrounds said elongated lamp.

39. An electric space heater according to claim 34 wherein said foraminous sheet is in closely spaced relationship to said elongated lamp.

40. An electric space heater according to claim 34 wherein said foraminous sheet has a high thermal conductivity.

* * * * *

UNITED STATES PATENT AND TRADEMARK OFFICE

CERTIFICATE OF CORRECTION

PATENT NO. : 4,900,898

DATED : February 13, 1990

INVENTOR(S) : WILLIAM E. KLING, Deceased by SUE A. KLING, Executrix

It is certified that error appears in the above-identified patent and that said Letters Patent is hereby corrected as shown below:

Claim 7, column 7, line 16:
after "sheet" insert --material--.

Signed and Sealed this

Twenty-fifth Day of February, 1992

*Attest:*

*Attesting Officer*

HARRY F. MANBECK, JR.

*Commissioner of Patents and Trademarks*